US007422339B2

(12) United States Patent
Jordan

(10) Patent No.: US 7,422,339 B2
(45) Date of Patent: Sep. 9, 2008

(54) CHEMILUMINESCENT CONTAINER SYSTEM

(76) Inventor: Andrew S. Jordan, 100 Conestoga Dr., Marlton, NJ (US) 08053

( * ) Notice: Subject to any disclaimer, the term of this patent is extended or adjusted under 35 U.S.C. 154(b) by 75 days.

(21) Appl. No.: 11/013,284

(22) Filed: Dec. 15, 2004

(65) Prior Publication Data

US 2006/0126322 A1 Jun. 15, 2006

(51) Int. Cl.
*F21K 2/06* (2006.01)

(52) U.S. Cl. ..... 362/34

(58) Field of Classification Search ..... 362/34; 206/222

See application file for complete search history.

(56) References Cited

U.S. PATENT DOCUMENTS 3,819,925 A * 6/1974 Richter et al. ..... 206/219
4,563,726 A * 1/1986 Newcomb et al. ..... 362/34
5,171,081 A 12/1992 Pita et al.
5,209,692 A 5/1993 Coleman et al.
5,671,998 A * 9/1997 Collet ..... 362/101
6,062,380 A 5/2000 Dorney
6,371,624 B1 * 4/2002 Dorney ..... 362/34
6,474,467 B1 * 11/2002 Kurdian ..... 206/222
6,520,657 B1 * 2/2003 DeNicola ..... 362/34
6,739,731 B2 * 5/2004 Katzman ..... 362/101
6,964,492 B1 * 11/2005 Nicklowitz ..... 362/101
7,017,736 B2 * 3/2006 Cohen et al. ..... 206/222

OTHER PUBLICATIONS

Spin Pop History, www.spinpopcollector.com/History.htm. Nov. 4, 2002.

* cited by examiner

*Primary Examiner*—Jong-Suk (James) Lee
*Assistant Examiner*—Leah S Lovell
(74) *Attorney, Agent, or Firm*—Rudoler & DeRosa LLC

(57) ABSTRACT

A chemiluminescent container system comprises an outer container forming an outer cavity for holding a first fluid and an internal cavity located within the outer cavity for holding a chemiluminescent device. The chemiluminescent device is secured to the outer container within the internal cavity and comprises an outer container for holding a first chemiluminescent material and a frangible inner container which holds a second chemiluminescent material. The chemiluminescent device further comprises an actuator formed on the outer container of the chemiluminescent device in a location accessible to a user for breaking the frangible inner container and admixing the first and second chemiluminescent materials to produce a chemiluminescent effect.

20 Claims, 3 Drawing Sheets

CHEMILUMINESCENT CONTAINER SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISK APPENDIX

Not Applicable.

BACKGROUND OF THE INVENTION

The invention generally relates generally to chemiluminescent devices, and more particularly pertains to a novelty container system for holding a liquid, preferably comestible, and a separate chemiluminescent device that is actuatable by a user.

BRIEF SUMMARY OF THE INVENTION

In one preferred embodiment of the invention, a chemiluminescent container system comprises an outer container forming an outer cavity for holding a first fluid and an internal cavity located within the outer cavity for holding a chemiluminescent device. The chemiluminescent device is secured to the outer container within the internal cavity and comprises an outer container for holding a first chemiluminescent material and a frangible inner container which holds a second chemiluminescent material. The chemiluminescent device further comprises an actuator formed on the outer container of the chemiluminescent device in a location accessible to a user for breaking the frangible inner container and admixing the first and second chemiluminescent materials to produce a chemiluminescent effect.

The internal cavity may protrude into the outer cavity and is coextensive with the outer container of the chemiluminescent device such that the fluid in the outer cavity surrounds the internal cavity. The internal cavity may be coaxial with the outer cavity such that the fluid in the outer cavity entirely surrounds the internal cavity.

The actuator may comprise a flexible wall which is displaceable by a user for engaging with the chemiluminescent device. The flexible wall may have a dome shape and may extend within the outer container of the chemiluminescent device. The flexible wall may be formed on a bottom wall of the chemiluminescent device and wherein the wall of the chemiluminescent device may form a bottom wall of the outermost container.

The outer container of the chemiluminescent device may have a neck portion. The inner container may comprise a first end and a second end, the first end having a peripheral wall capable of engaging the neck portion and the second end being engageable with the actuator whereby actuating the actuator applies a force to the frangible inner container when the peripheral wall engages the neck portion.

The internal cavity may have an elongated shape and the chemiluminescent device may have a complementary elongated shape.

The container system may further comprise a frangible seal covering the actuator for preventing premature actuation of thereof.

The container system may further comprise a spout formed on the outermost container in fluid communication with the fluid in the outer cavity.

The outermost container May further comprise a first connector and the chemiluminescent device may comprise a complementary connector for engaging with the first connector for securing the chemiluminescent device to the outer container.

The internal cavity may be thermally insulated from the fluid in the outer cavity.

BRIEF DESCRIPTION OF THE SEVERAL VIEWS OF THE DRAWING

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENT

Figure 1:
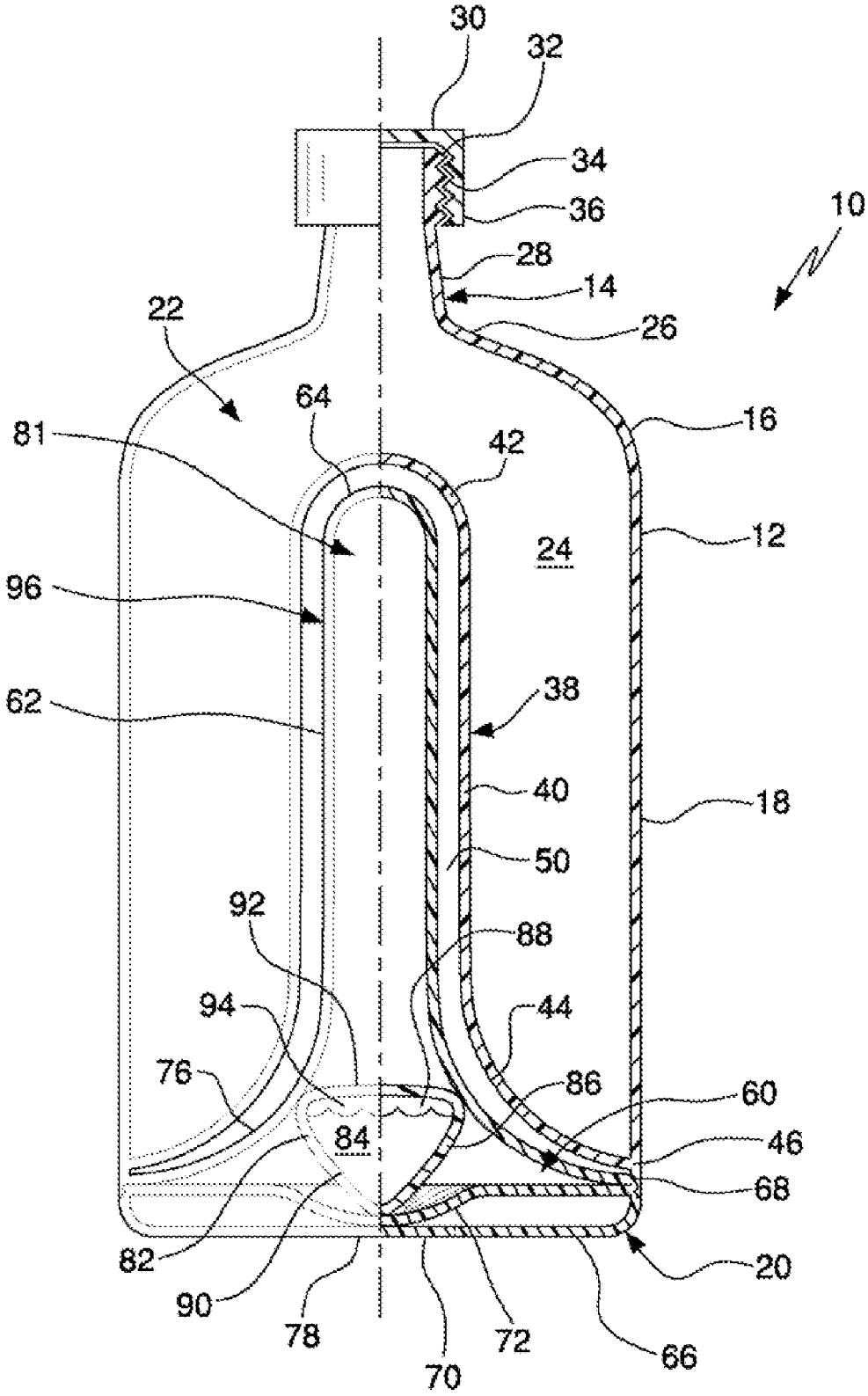
FIG. 1 is a front view of the preferred embodiment of the chemiluminescent container system constructed in accordance with the principles of the present invention.
Figure 2:
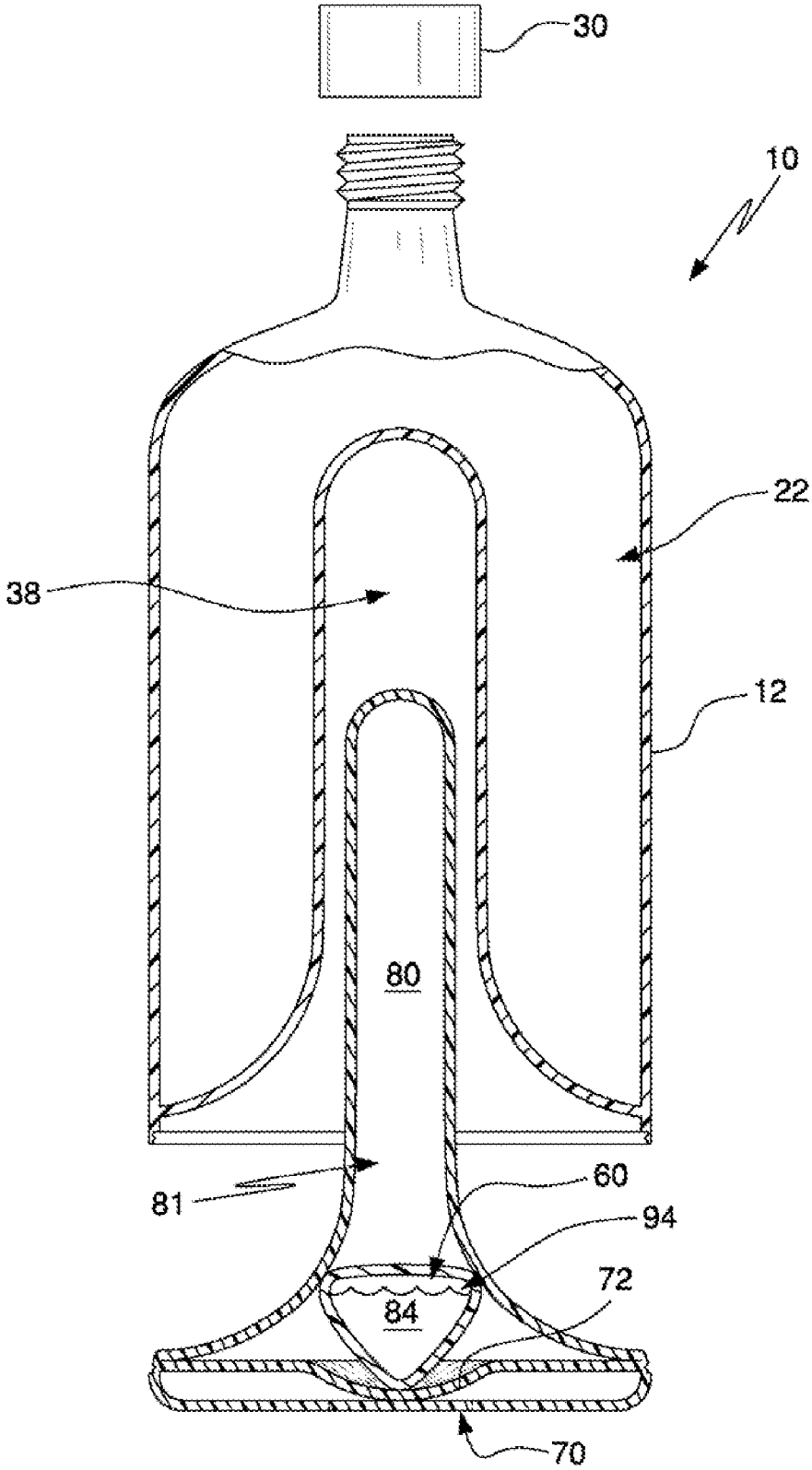
FIG. 2 is an exploded front view the present invention taken depicted in FIG. 1.
Figure 3:
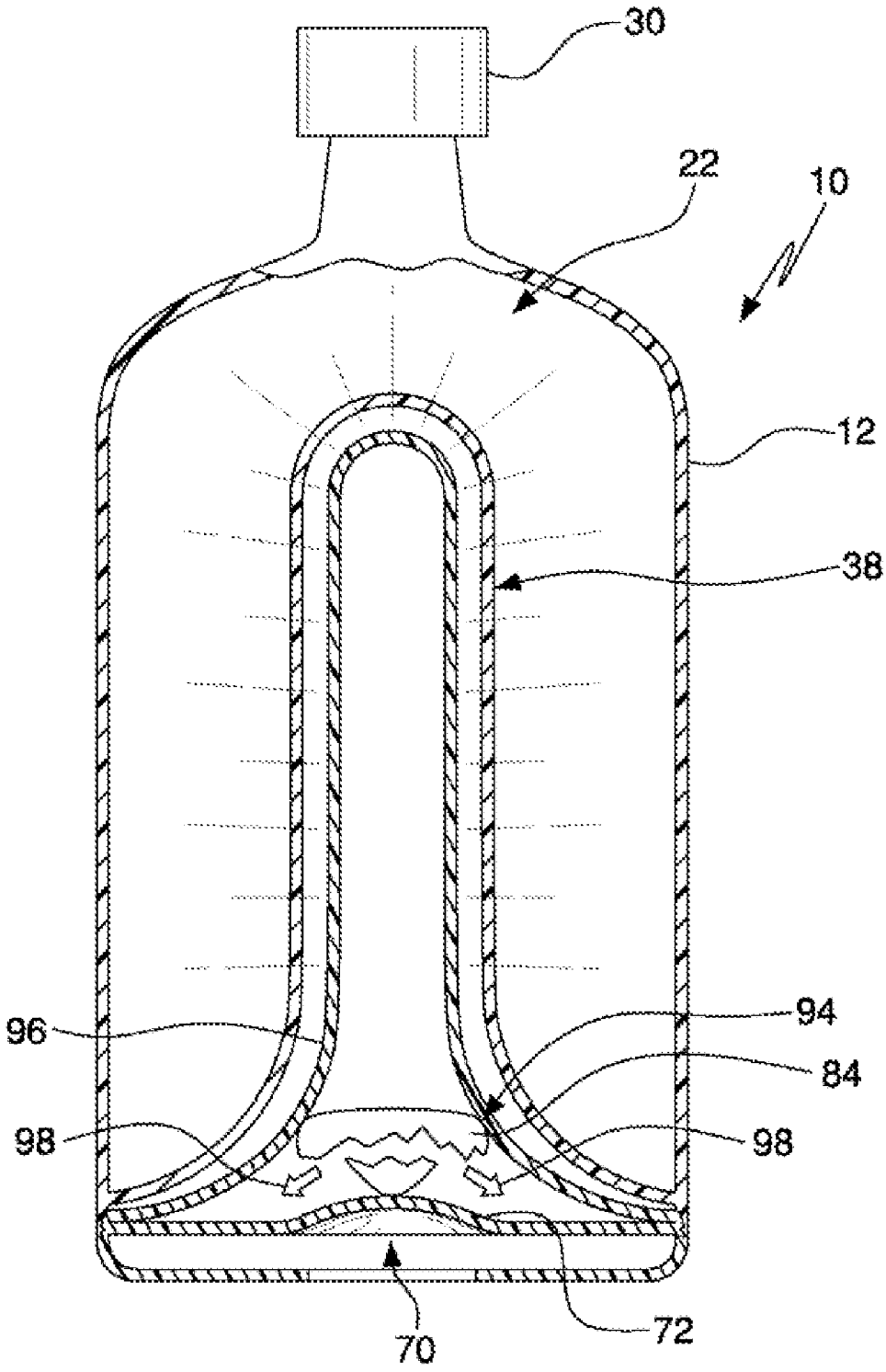
FIG. 3 is a front view of the present invention shown being actuated.

Referring to FIGS. 1 to 3, a preferred embodiment of chemiluminescent container system 10 is disclosed. The container system 10 comprises an outermost container 12. The outer container 12 is depicted as having a generally cylindrical shape; however, it should be understood that the container may have any suitable shape, including ornamental shapes.

The outermost container 12 comprises an upper spout portion 14, a tapered intermediate wall portion 16, and a generally cylindrical wall portion 18 that tapers to bottom walled portion 20 and extends within and into the outer container 12 as described in greater detail below.

The outermost container 12 forms an outer cavity 22 for holding any suitable fluid 24, such as a liquid, a granular solid or the like. In the preferred embodiment, the fluid 24 comprises a potable liquid such as a beverage and the outer container is in the shape of a conventional pint-sized beverage bottle as is well-known in the art.

Typically, the spout portion 14 can be in the form of a longitudinally coaxial central opening formed in the upper portion of the outermost container 12 as shown. In this version of the invention, the spout portion on 14 has a tapered neck portion 26 and an outwardly extending cylindrical spout portion 28 for receiving a cap 30. The spout 28 may include an attachment means 32 for co-acting with cooperative attachment means 34 formed on an internal longitudinally extending wall 36 of the cap 30. Typically the attachment means takes the form of a cooperating threaded connection as illustrated, however, it should be understood that the connection can take any suitable form for securing the cap 30 to the container 12 and sealing the fluid 24 in the cavity 22 as is well-known in the art.

In the preferred embodiment, the walls of the outermost container 12 are formed from a thermoplastic material, such as PET or polypropylene, as is well-known in the art. Of course, it should be understood that the container may be formed from any inexpensive material with similar material properties. In addition, the walls of the outermost container 12 are preferably translucent or transparent for transmitting and radiating light from the chemiluminescent device as described below to present a pleasing, visual effect to the user or viewers of the invention.

Turning now to the bottom wall portion 20 of the container 12, the bottom wall portion 20 is in the shape of a rounded frustoconical inner container 38 which extends into the outer cavity 22 of the outermost container 12 from the bottom of the container. The bottom wall portion 20 includes a generally cylindrical elongated body 40 which terminates into a flattened or rounded closed first end 42 on one end and has a radially tapering second end 46 that tapers outwardly at wall portion 44 to meet the bottom portion of the outermost container 12. In this way, the wall portions 16, 18, 20, 40, 42 and 44 form the sealed outer cavity 22 in conjunction with the cap 30.

In the preferred invention, the container 12 is blow-molded in one piece, but it should be understood that the container walls can be formed or otherwise connected by any suitable process, such as adhesively, chemically, mechanically, ultrasonic welding, or the like. This is especially relevant for the connection of the portion of the inner container 38 with the bottom portion 46 of the outermost container 12. Manufacturing considerations will influence the nature of this connection depending upon such factors as manufacturing costs, connection strengths, or the like.

The inner container 38 forms an inner cavity 50 that is adapted to receive a suitable chemiluminescent device 60 through the opening 20 formed at the bottom of the outermost container 12. In one preferred form of the invention, the walls 40, 42, 44, and 46 comprising the inner container 38 can be made from a material or have a thickness than imparts insulative qualities to regulate the temperature inside the inner container 38 and insulate the chemiluminescent device 60 from the fluid 24 in the outer cavity 22 which may be chilled and which thereby may affect the preferred operating temperature of the chemiluminescent device 60 which is closer to room temperature. In addition, the strength of the material qualities ensure that any fluid in the inner cavity 50 (such as from the chemiluminescent device 60) does not enter or admix with the fluid in the cavity 22 which may be comestible for example. Preferably, the material of the inner container 38 should comply with any appropriate guidelines, such as the FDA guidelines, when the fluid 24 is ingestible.

It should also be understood that the walls of the inner container 38 are transparent or translucent for transmitting and radiating light from the chemiluminescent device as described below to present a pleasing visual effect to the user or viewers of the invention.

In the preferred form of the invention, the chemiluminescent device 60 is similar to a convention glowstick with respect to the chemiluminescent chemicals and materials used as set forth in greater detail below.

The chemiluminescent device 60 has an elongated body 62 having a first closed end wall 64 and a second opposite closed end wall 66. The second closed end wall 66 comprises a connection means 68 for attaching the device 60 to the outer container 12. In the preferred form of the invention, the connection means 68 takes the form of integral cooperating threads on both the peripheral wall of the device 60 and the inner peripheral wall of the inner container 38. In this way, the bottom wall 20 serves as a plug for the inner container 38 to form a suitable fluid-tight connection for containing any fluid that may enter the inner container 38, such as chemiluminescent liquid that may seep or otherwise escape from the device 60. It should be understood that the connection means 68 may take any suitable shape or form that adequately seals the inner container 38, protects the device 60 and protects the fluid 24 in the cavity 22 from contamination from the device 60 or material in the cavity 50.

An actuator 70 is formed in the central longitudinal area of the second closed end or bottom wall 66. In the preferred form of the invention the actuator 70 takes the form of a flexible convex dome 72 that can be deflected or displaced inwardly by the user. It should be understood that the actuator 70 can take other suitable forms that serve to apply a force into the inner cavity 81 formed by the outer walls of the device 60, such as a bellows shape, a distensible or displaceable protrusion, or the like. It should be understood that the bottom wall 66 can be shaped to have a generally flat shape or otherwise emulate a suitable shape, including the formation of stand feet, that allows the container 12 to rest in an upright position on a generally flat surface.

The elongated body 62 of the device 60 preferably is substantially rigid and has tapered walls 76 to form a neck in the walls. In the preferred form of the invention, the body 62 should conform to and fit within the inner container 38.

The device 60 holds a first chemiluminescent material 80 in a cavity 81. Also, disposed within the cavity 81 is an internal frangible container 82 which holds a second chemiluminescent material 84.

The inner frangible container 82 comprises an outer wall 86 forming an internal cavity 88 for holding the second chemiluminescent material 84. The internal container 82 has a first end 90 which tapers out to a larger second end wall 92. The periphery 94 of end wall 92 is sized to rest against the neck 76 of the wall 62 and the tip of the end wall 90 is positioned to rest against the dome 72 of the actuator 70 such that when the actuator 70 is displaced inwardly a force is applied to the tip 90 of the internal container 82. The inner container 82 has frangible or otherwise breakable walls that will break the inner container 82 when a force is applied by the actuator 70 to the inner container 82 since the periphery 94 of the second end wall 92 is jammed against the neck 76 of the wall 62 preventing lateral movement of the inner container 82. In this way the chemiluminescent materials 80 and 84 mix in the cavity 81 to produce a chemiluminescent effect which transmits light from the device 60 through the walls of the inner container 38 which are transparent or translucent, and thereafter through the outer walls of the container 12 to produced the aforementioned visual effect.

A frangible seal 78 may be provided on the bottom wall 66 of the container covering the actuator 70. The seal 78 prevents inadvertent or intentional actuation of the actuator 70 prior to end sale or use. The seal can take any suitable shape that adequately protects the actuator 70. In the embodiment shown, the seal 78 includes a perforated connection 79 around the periphery of the seal 78 for attachment to the bottom wall 66.

It should be understood that the shape of the chemiluminescent device 60 and the co-action of the actuator 70 with the internal container 82 and the outer container device 96 can take many suitable shapes that permit easy actuation and breakage of the internal container 82 and the mixture of the fluids 80 and 84 therein.

In use, an end user removes the optional frangible seal 78 if present to uncover the actuator 70. When actuation of the device is desired, the user presses on or otherwise displaces or distends the flexible dome 72, applying a force to the tip 90 of the frangible inner container 82. The peripheral walls 94 press against the internal container 82 against the neck 76 of the outer container 96 of the chemiluminescent device 60 preventing further inward movement of the inner container 82 and internalizing the applied forces to the frangible walls of the inner container 82 and breaking them, as best seen in FIG. 3.

Once the walls of the inner container 82 are broken, the second chemiluminescent fluid 84 can escape from the container 82 and admix with the first chemiluminescent fluid 80 in the outer container 94 creating a chemiluminescent effect. Light from the chemiluminescent reaction radiates from the activated chemiluminescent device 60 through the walls of the inner container 38, through the fluid 24 in the outer container 12 and outwardly through the walls thereof where it can be viewed by anyone within visual range. The interaction between the chemiluminescent reaction and the contained fluid 24 also contributes to the pleasing visual effect produced.

It should be stressed that at no time can the chemiluminescent fluid escape from the inner container 38 or enter into the cavity 22 containing the fluid 24, especially if the fluid 24 is meant to be consumed or ingested by a user.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A chemiluminescent container system comprising:

an outermost container forming an outer cavity for holding a first fluid and an internal cavity located within the outer cavity for holding a chemiluminescent device;

the chemiluminescent device being secured to the outermost container within the internal cavity and comprising an outer container for holding a first chemiluminescent material and a frangible inner container which holds a second chemiluminescent material; and the chemiluminescent device further comprising an actuator formed on the outer container of the chemiluminescent device in a location accessible to a user for breaking the frangible inner container while the chemiluminescent container is secured within the internal cavity and admixing the first and second chemiluminescent materials to produce a chemiluminescent effect.

2. The chemiluminescent container system according to claim 1 wherein the internal cavity protrudes into the outer cavity and is coextensive with the outer container of the chemiluminescent device such that the fluid in the outer cavity surrounds the internal cavity.

3. The chemiluminescent container system according to claim 2 wherein the internal cavity is coaxial with the outer cavity such that the fluid in the outer cavity entirely surrounds the internal cavity.

4. The chemiluminescent container system according to claim 1 wherein the actuator comprises a flexible dome shaped wall which is displaceable by a user for engaging with the chemiluminescent device, wherein the flexible wall is formed on a bottom wall of the chemiluminescent device, and wherein the bottom wall of the chemiluminescent device forms a bottom wall of the outermost container.

5. The chemiluminescent container system according to claim 1 wherein the internal cavity has an elongated shape and the chemiluminescent device has a complementary elongated shape.

6. The chemiluminescent container system according to claim 1 further comprising a frangible seal covering the actuator for preventing premature actuation of thereof.

7. The chemiluminescent container system according to claim 1 further comprising a spout formed on the outermost container in fluid communication with the fluid in the outer cavity.

8. The chemiluminescent container system according to claim 1 wherein the outermost container further comprises a first connector and the chemiluminescent device comprises a complementary connector for engaging with the first connector for securing the chemiluminescent device to the outermost container.

9. The chemiluminescent container system according to claim 1 wherein the internal cavity is thermally insulated from the fluid in the outer cavity.

10. The chemiluminescent container system according to claim 1 wherein the inner and outer containers of the chemiluminescent device are located inside the internal cavity.

11. The chemiluminescent container system according to claim 1 wherein the outer container of the chemiluminescent device has an elongated generally cylindrically shaped end which tapers out to a wider end, and wherein the inner container has peripheral end walls at its base that engage with the tapered portion of the outer container.

12. The chemiluminescent container system according to claim 11 wherein the outer container has an elongated end and the neck is located at a tapering portion of the outer container and wherein the inner container of the chemiluminescent device has a conical shape with the first end being a base of the cone shape and the second end being a tip of the cone shape.

13. The chemiluminescent container system according to claim 1 wherein the actuator comprises a flexible wall which is displaceable by a user for engaging with the chemiluminescent device.

14. The chemiluminescent container system according to claim 1 wherein the inner container of the chemiluminescent device has a conical shape.

15. A chemiluminescent container system comprising:

an outermost container forming an outer cavity for holding a first fluid and an internal cavity located within the outer cavity for holding a chemiluminescent device;

the chemiluminescent device being secured to the outermost container within the internal cavity and comprising an outer container for holding a first chemiluminescent material and a frangible inner container which holds a second chemiluminescent material; and the chemiluminescent device further comprising an actuator formed on the outer container of the chemiluminescent device in a location accessible to a user for breaking the frangible inner container and admixing the first and second chemiluminescent materials to produce a chemiluminescent effect, the actuator comprising a flexible wall having dome shape which is displaceable by a user for engaging with the chemiluminescent device and which extends within the outer container of the chemiluminescent device.

16. A chemiluminescent container system comprising:

an outermost container forming an outer cavity for holding a first fluid and an internal cavity located within the outer cavity for holding a chemiluminescent device;

the chemiluminescent device being secured to the outermost container within the internal cavity and comprising an outer container for holding a first chemiluminescent material and a frangible inner container which holds a second chemiluminescent material; and the chemiluminescent device further comprising an actuator formed on the outer container of the chemiluminescent device in a location accessible to a user for breaking the frangible inner container and admixing the first and second chemiluminescent materials to produce a chemiluminescent effect, the actuator comprising a flexible wall formed on a bottom wall of the chemiluminescent device which is displaceable by a user for engaging with the chemiluminescent device, the wall of the chemiluminescent device forming a bottom wall of the outermost container.

17. A chemiluminescent container system comprising:

an outermost container forming an outer cavity for holding a first fluid and an internal cavity located within the outer cavity for holding a chemiluminescent device;

the chemiluminescent device being secured to the outermost container within the internal cavity and comprising an outer container for holding a first chemiluminescent material and a frangible inner container which holds a second chemiluminescent material; and the chemiluminescent device further comprising an actuator formed on the outer container of the chemiluminescent device in a location accessible to a user for breaking the frangible inner container and admixing the first and second chemiluminescent materials to produce a chemiluminescent effect;

the outer container of the chemiluminescent device having a neck portion, wherein the inner container comprising a first end and a second end, the first end having a peripheral wall capable of engaging the neck portion and the second end being engageable with the actuator whereby actuating the actuator applies a force to the frangible inner container when the peripheral wall engages the neck portion.

18. The chemiluminescent container system according to claim 17 wherein the actuator comprises a flexible dome shaped wall which is displaceable by a user for engaging with the chemiluminescent device, wherein the flexible wall is formed on a bottom wall of the chemiluminescent device, and wherein the bottom wall of the chemiluminescent device forms a bottom wall of the outermost container.

19. The chemiluminescent container system according to claim 18 wherein the internal cavity protrudes into the outer cavity and is coextensive with the outer container of the chemiluminescent device such that the fluid in the outer cavity surrounds the internal cavity.

20. A chemiluminescent container system comprising:

an outermost container forming an outer cavity for holding a first fluid and an internal cavity located within the outer cavity for holding a chemiluminescent device;

the chemiluminescent device being secured to the outermost container within the internal cavity and comprising an outer container for holding a first chemiluminescent material and a frangible inner container which holds a second chemiluminescent material; and the chemiluminescent device further comprising an actuator formed on the outer container of the chemiluminescent device in a location accessible to a user for breaking the frangible inner container and admixing the first and second chemiluminescent materials to produce a chemiluminescent effect;

the actuator being located on the bottom end wall of outer container, the bottom end wall being coaxially disposed with the bottom end wall of the outermost container.

* * * * *